US006843245B2

(12) United States Patent
Roch et al.

(10) Patent No.: US 6,843,245 B2
(45) Date of Patent: Jan. 18, 2005

(54) HIGH-LEVEL BUILT-IN OVEN UNIT

(75) Inventors: Klemens Roch, Trostberg (DE); Christian Zimmermann, Garching/Alz (DE); Peter Mallinger, Traunreut (DE); Wolfgang Schneii, Trostberg (DE); Klaus Rabenstein, Trostberg (DE); Josef Gerl, Palling (DE); Michael Wagner, Grabenstatt (DE); Reinhard Fleissner, Altenmarkt (DE); Christian Unterreiner, Ainring (DE); Johann Herbst, Traunreut (DE); Bernd Hopfenmuller, Traunreut (DE); Edmund Kuttalek, Grassau (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/449,529

(22) Filed: May 29, 2003

(65) Prior Publication Data

US 2004/0099259 A1 May 27, 2004

(30) Foreign Application Priority Data

Dec. 1, 2000 (DE) ..... 100 59 651

(51) Int. Cl.[7] ..... F24C 15/34

(52) U.S. Cl. ..... 126/273 A; 126/19 M; 126/337 A; 312/247; 312/312; 219/403

(58) Field of Search ..... 126/337 R, 334, 126/332, 337 A, 335, 339, 19 R, 19 M, 21 R, 273 A, 37 B, 340; 219/403, 404; 312/247, 272, 300; 211/153, 154, 181.1

(56) References Cited

U.S. PATENT DOCUMENTS

| | | | | |
|---|---|---|---|---|
| 1,351,415 A | * | 8/1920 | Coumerilh | 126/337 R |
| 2,003,059 A | * | 5/1935 | Teller et al. | 126/37 R |
| 2,889,442 A | | 6/1959 | Schultz | |
| 2,944,540 A | | 7/1960 | Littell, Jr. | |
| 4,796,599 A | * | 1/1989 | Cooper | 126/30 |
| 6,073,624 A | | 6/2000 | Laurent | |

* cited by examiner

*Primary Examiner*—James C. Yeung
(74) *Attorney, Agent, or Firm*—John T. Winburn

(57) ABSTRACT

A high-level built-in oven unit including a bottom opening in the oven unit. A removable trap-door including lifting elements to open and close the bottom opening of the oven unit. The trap door has a baking tray mounting arrangement detachably mounted thereon.

20 Claims, 7 Drawing Sheets

HIGH-LEVEL BUILT-IN OVEN UNIT

BACKGROUND OF THE INVENTION

Field of the Invention

The present invention relates to a high-level built-in oven unit and, in particular, to a high-level built-in oven with a lowerable trap-door and a baking tray mounting arrangement.

The wall-mounted oven known from the WO 98/04871 publication should be considered as a generic high-level built-in oven unit. The wall-mounted oven includes a cooking space or an oven chamber which is surrounded by sidewalls, a front, back and upper wall and which has an opening in its floor, whereby the back of the wall-mounted oven is to be mounted on a wall in the manner of a kitchen wall unit. The opening in the floor of the oven chamber can be closed by a lowerable trap-door. A support arrangement or a fixing piece for baking trays and other oven accessories is mounted on the upper surface of the trap-door.

In order to adjust the trap-door the wall-mounted oven has a lifting device with lifting elements which are connected with the trap-door. The lifting elements are shaped as linkage levers which are pivotably mounted, on the one hand, inside the oven chamber on its sidewalls and, on the other hand, on the fixing piece for baking trays, which is mounted on top of the trap-door. When the trap-door is adjusted the linkage levers may be pivoted parallel to a level of the sidewalls of the oven chamber.

One of the ends of the linkage levers mounted on the sidewalls of the oven chamber is non-rotatably connected with an actuating shaft. This actuating shaft protrudes from a sidewall of the oven chamber and may be driven by a drive motor located outside the oven chamber. Thus when the drive motor is activated the linkage levers may be pivotally adjusted.

The pivotal mounting of the linkage levers on the fixing piece requires a comparatively complicated constructional assembly of the fixing piece. This means that cleaning of the fixing piece which is exposed to contamination is costly. Further, since the fixing piece is stationarily mounted on the trap-door, it is difficult to access for cleaning.

The present invention includes a high-level built-in oven unit which facilitates cleaning of the fixing piece of a baking tray mounting arrangement easier.

BRIEF SUMMARY OF THE INVENTION

The fixing piece of the baking tray mounting arrangement is detachably connected with the trap-door. Therefore the fixing piece can be removed from the trap-door following a cooking operations and cleaned spatially separate from the high-level built-in oven unit in a dishwasher.

According to a special embodiment of the invention, the fixing piece of the baking tray mounting arrangement is arranged spatially separate from the lifting elements. In contrast to the state of the art the baking tray mounting arrangement is not an integrated part of the lifting elements. This means that the baking tray mounting arrangement can be specially adapted to suit the cleaning requirements in the high-level built-in oven unit without adversely affecting the function of the lifting elements.

In order to facilitate easy handling of the fixing piece by a user it is especially favourable to design the connection of the fixing piece with the trap-door in such a way that the removal of the fixing piece from the trap-door or the attachment of the fixing piece to the trap-door can be carried out by the user without using any tools.

A particularly simple attachment on, or removal of the fixing piece from, the trap-door can be achieved if the fixing piece is fixed by means of an easy-to-detach plug-in connection. To achieve such a plug-in connection the fixing piece includes at least one plug-in portion which may be plugged into a corresponding anchoring of the baking tray mounting arrangement fastened to the trap-door.

A constructionally particularly simple design of the plug-in connection includes the anchoring in the door including a cylindrical base and the plug-in connection of the fixing piece having a corresponding hollow profile.

In order to ensure an accurate positioning of the fixing piece on the base of the floor-side anchoring, a positioning pin is provided on the base. When the fixing piece is accurately positioned on the base, the positioning pin is received in a recess of the plug-in connection of the fixing piece. If, however, the positioning pin and the recess are not aligned with each other, the fixing piece cannot be placed onto the base.

In order to avoid contamination of the floor-side anchoring of the baking tray mounting arrangement, the anchoring is covered by a heat-resistance plate in such a way that only the base of the anchoring protrudes through a mounting hole in the heat-resistant plate.

The anchoring of the baking tray mounting arrangement is even more effectively protected against contamination if an O-ring seal is arranged between an annular flange of the cylindrical base and a circumferential area of the mounting hole of the heat-resistant plate. In this way the mounting hole in the heat-resistant plate is sealed hermetically towards the base.

In this context it is especially advantageous to manufacture the heat-resistant plate from a material with a small thermal expansion coefficient, preferably from a glass-ceramic material. Due to the small thermal expansion coefficient of glass-ceramics thermal deformations of the plate, which adversely affect the operability of the above mentioned seal between the base and the heat-resistant plate, are almost totally prevented during operation of the high-level built-in oven unit.

It is particularly favourable from both a manufacturing and an assembly point of view if the fixing piece includes two support columns identical to each other and if the support columns can be plugged with their plug-in portions onto corresponding identical anchorings. By designing the support columns as well as the anchorings in an identical way the manufacturing cost are considerably reduced and assembly is simplified.

BRIEF DESCRIPTION OF THE DRAWING

An embodiment of the invention will now be described with reference to the attached drawings of which.

DETAILED DESCRIPTION OF THE INVENTION

Figure 1:
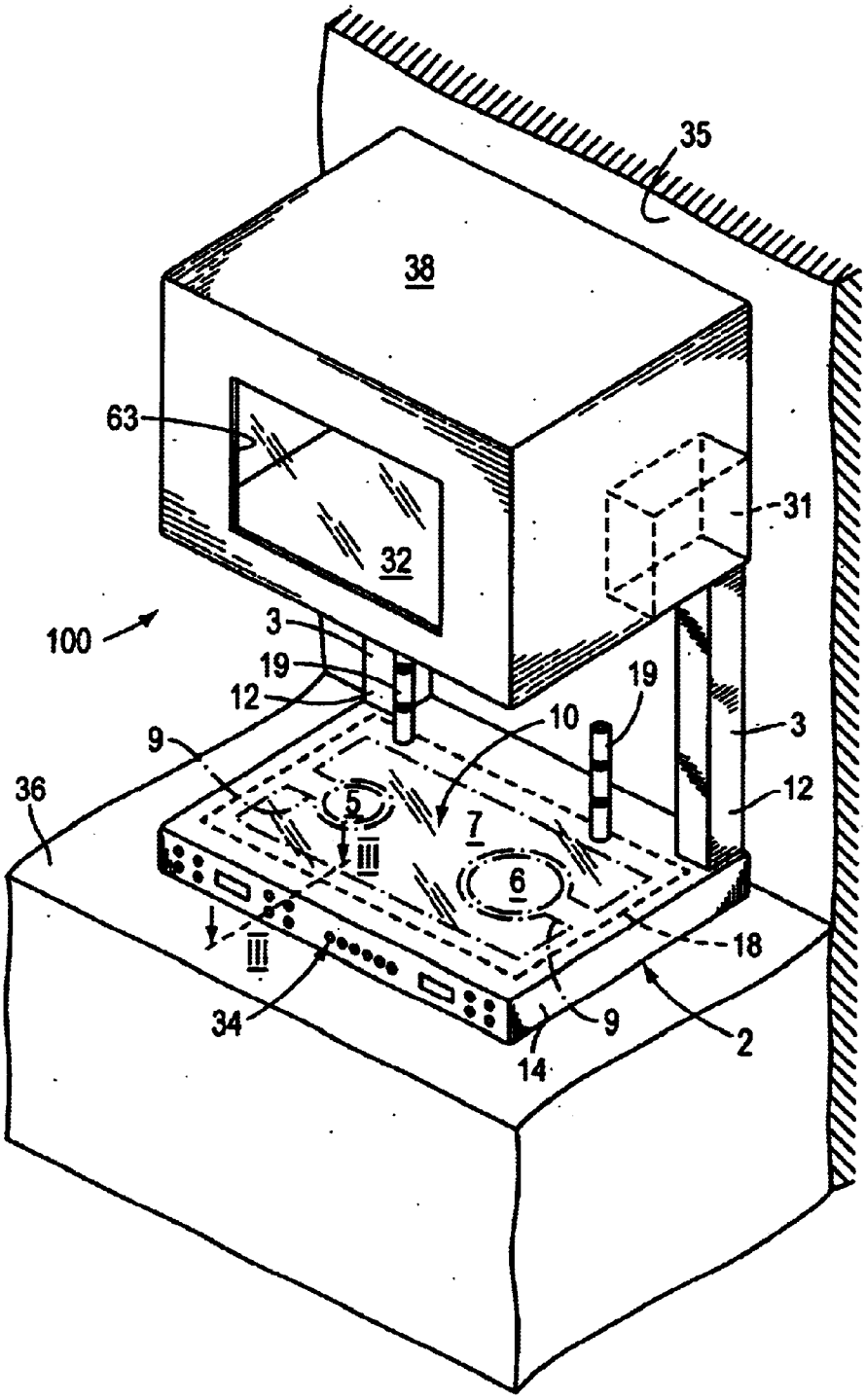
FIG. 1 shows a perspective view of a wall-mounted high-level built-in oven unit with lowered trap-door.
Figure 4:
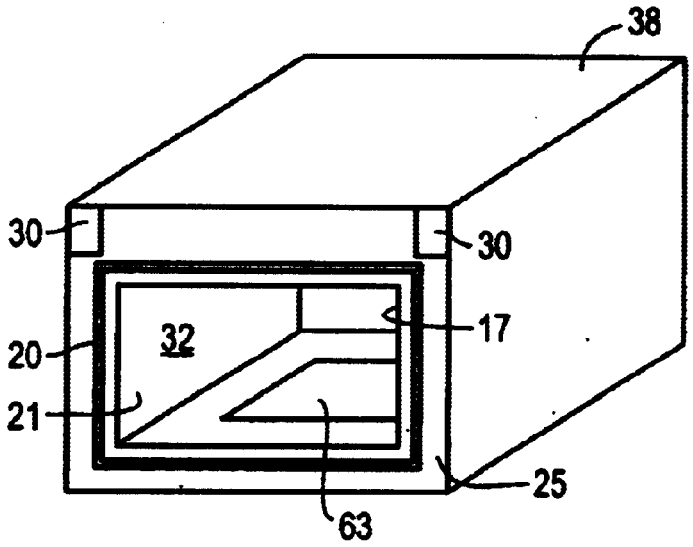
FIG. 4 shows a perspective view of a housing of the wall-mounted high-level built-in oven unit without trap-door.

FIG. 1 shows a high-level built-in oven unit 100 with a housing 38. The rear of the housing 38 is mounted onto a wall 35 in the manner of a wall-mounted kitchen unit. In the housing 38 a cooking space 32 is defined which may be inspected via a window 63 inserted into the front of the housing 38. FIG. 4 shows that the cooking space 32 is defined by a heated chamber 21 provided with a heat-insulating casing not shown, and that the heated chamber 21 has a floor opening 17. The floor opening 17 can be closed, for example, by a trap-door 2 shown in FIGS. 1 and 2. In FIG. 1 the trap-door 2 is shown in the lowered position, whereby its bottom surface is in contact with a work surface 36 of a kitchen unit.

Figure 2:
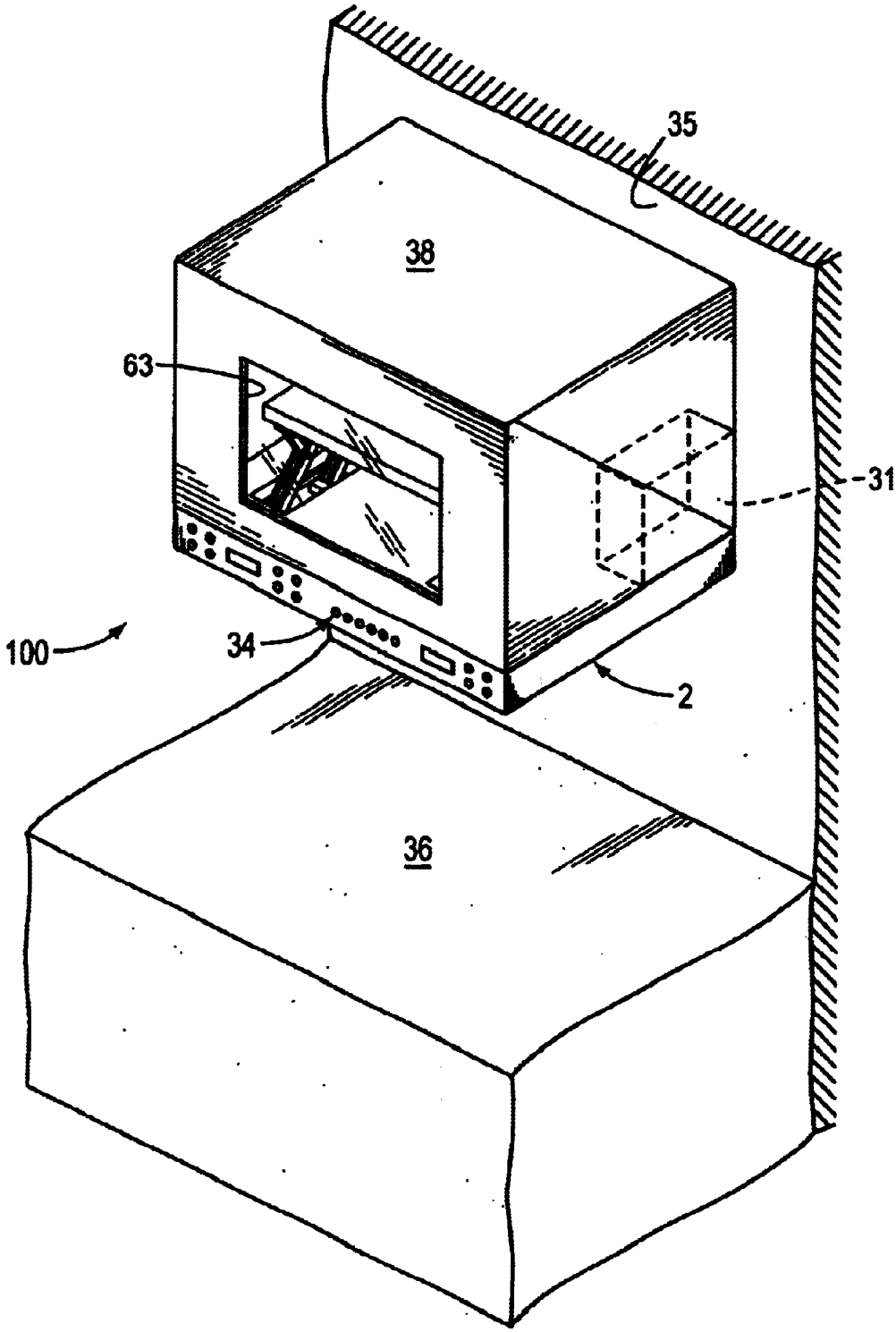
FIG. 2 shows a perspective view of a wall-mounted high-level built-in oven unit with closed trap-door.
Figure 5:
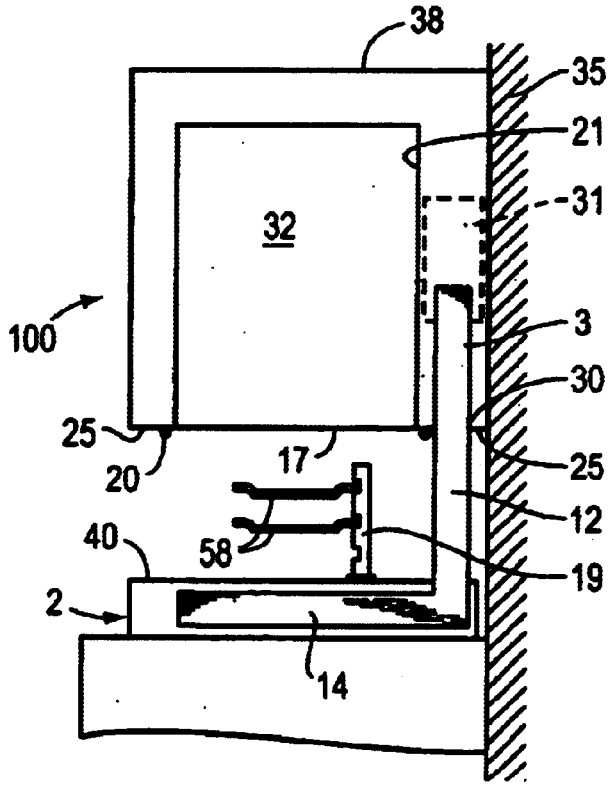
FIG. 5 shows a schematic side view of the wall-mounted high-level built-in oven unit with lowered trap-door.
Figure 6:
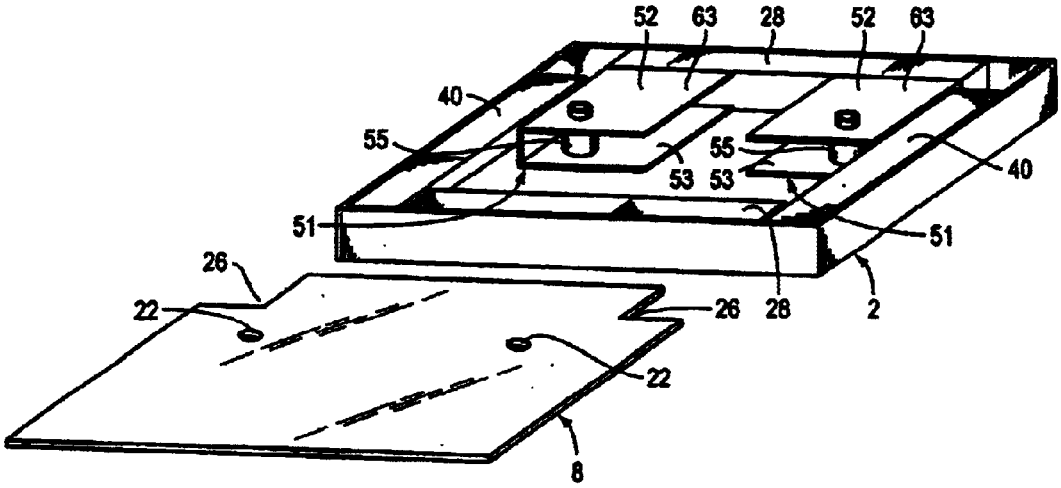
FIG. 6 shows a perspective view of the trap-door without lifting elements, whereby the glass-ceramic plate 8 has been removed from the trap-door.

In order to close the cooking space 32 the trap-door 2 must be moved into the position shown in FIG. 2. In order to move the trap-door 2 the high-level built-in oven unit 100 includes a lifting device 3, 31. The lifting device 3, 31 includes a drive motor 31 shown as a broken line in FIGS. 1, 2 and 5, which is arranged between the heated chamber 21 and the outside wall of the housing 38. The drive motor 31 is arranged in the area of the rear of the housing 38 and is, as shown in FIG. 1 or 5, effectively connected with one of a pair of lifting elements 3 connected with the trap-door 2. According to the schematic side view in FIG. 5 each lifting element 3 is shaped as an L-shaped support. The vertical arm 12 of the L-shaped support 3 extends starting from the drive motor 31 on the housing 38, through frame openings 30 of a floor frame 25 and may be inserted into or retracted from the housing 38 in a vertical direction. The horizontal arm 14 of the L-shaped support 3 engages into a support portion 40 of the trap-door 2 in order to support the trap-door 2. A support portion 40 of this kind is formed on each narrow side of the trap-door 2 as shown in FIG. 6. FIG. 6 shows a perspective view of a profiled sheet 52 of the trap-door 2 as well as of a glass-ceramic plate 8 to be mounted on the profiled sheet 52. The support portions 40 were formed by bending upper portions of the sidewalls of the profiled sheet 52 of the trap-door 2 at 90° towards each other so that the horizontal arms 14 of the L-shaped supports 3 can grip underneath the support portions 40.

To adjust the trap-door 2, the drive motor 31 of the lifting device can be operated by means of a control on a control panel of a control unit 34, which is arranged on the front of the trap-door 2 as shown in FIGS. 1 and 2.

As can be seen from FIG. 1 the upper surface of the trap-door 2 includes a hob or cooktop 10. Most of the entire area of the hob 10 is occupied by heating elements 5, 6, 7, which are indicated by chain-dotted lines in FIG. 1. In FIG. 1 the heating elements 5, 6 are two hotplate heating elements of different size arranged at a distance from each other, whereas the heating elements 7 provided between the two hotplate heating elements 5, 6, is a sheet-type heating elements the side portions 9 of which almost enclose the hotplate heating elements 5, 6. The heating elements 5, 6, 7 are each associated with switching elements which can be controlled from the control unit 34, as will be described later.

In the embodiment shown the heating elements 5, 6, 7 are radiant heating elements which are covered by the glass-ceramic plate 8. The glass-ceramic plate 8 shown dissembled from the trap-door 2 in FIG. 6 has approximately the dimensions of the upper surface of the trapdoor 2. At its rear corners the glass-ceramic plate 8 has two recesses 26 on its outer circumference rim which can partially enclose the openings of the holders 40. Consequently the L-shaped supports 3 are connected with the trap-door 2 outside the glass-ceramic plate 8. In addition the glass-ceramic plate 8 also has mounting holes 22 through which bases 50 described later protrude for mounting a fixing piece 19 of a baking tray arrangement 19, 51.

Figure 3:
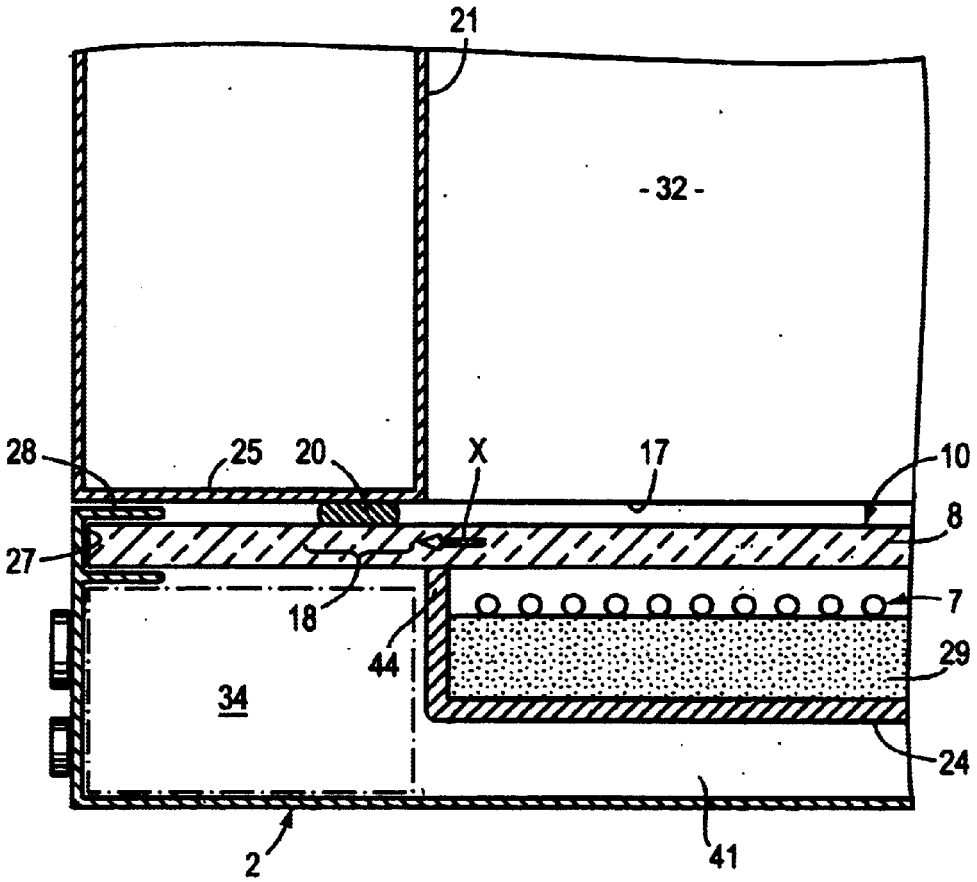
FIG. 3 shows an enlarged sectional view of the trap-door resting against the frame of the heated chamber along line III—III in FIG. 1.

According to the enlarged sectional view shown in FIG. 3 the upper surface of the trap-door 2 lies opposite the face of the floor frame 25. The glass-ceramic plate 8 of the trap-door 2 is surrounded on its circumference by a profiled frame 28 of a profiled sheet of the trap-door 2. A space 41 is formed between the glass-ceramic plate 8 and the bottom surface of the profiled sheet of the trap-door 2, in which the radiant heating elements 5, 6, 7 are arranged. For heat insulation the heating elements 5, 6, 7 are all received in a heating elements housing 24, the circumferential rim 44 of which is connected with an underside of the glass-ceramic plate 8. Inside the heating element housing 24 the radiant heating elements 5, 6, 7 are positioned on an insulating body 29. In addition the space 41 houses functional components indicated by chain-dotted lines such as electronic components of the control unit 34. These functional components are arranged in a boundary area of the trap-door 2.

As shown in FIG. 3 the hob 10 occupied by the heating elements 5, 6, 7 directly extends as far as the area of the inside wall of the heated chamber 21. In this way a far-reaching area forming the hob 10 is achieved on the upper surface of the trap-door 2. Due to the low thermal conductivity of the glass-ceramic plate 8 the temperature of the glass-ceramic plate 8 outside the hob 10 quickly drops in the direction marked with x when the hob 10 is in operation. Thus an excessively large heat dissipation in the glass-ceramic plate 8 in x-direction is avoided due to the low thermal conductivity of the glass-ceramic plate 8.

FIG. 3 also shows that a seal 20 is arranged between the glass-ceramic plate 8 and the floor frame 25. The seal 20 is fitted into the floor frame 25 in a manner not shown and extends frame-like around the floor opening 17. When the trap-door 2 is closed a sealed zone 18 is thus created between the floor frame 25, the seal 20 and the glass-ceramic plate 8. The hob 10 is arranged inside the sealed zone 18, whereas the already mentioned boundary area of the glass-ceramic plate 8 lies outside the sealed zone 18. The boundary area of the sealed zone 18 situated outside the sealed zone 18 in the x-direction is therefore thermally very effectively uncoupled relative to the cooking space 32. This thermally uncoupled boundary area of the glass-ceramic plate 8 warms up only slightly when the high-level built-in oven unit is operated with the trap-door 2 closed, so that it is possible to avoid the burning-on of food on the glass-ceramic plate 8 outside the sealed zone 18 and to protect users from high temperatures of the trap-door 2. The boundary area of the glass-ceramic plate 8 which is critical as regards cleaning can thus be easily cleaned after a cooking operation.

Figure 7:
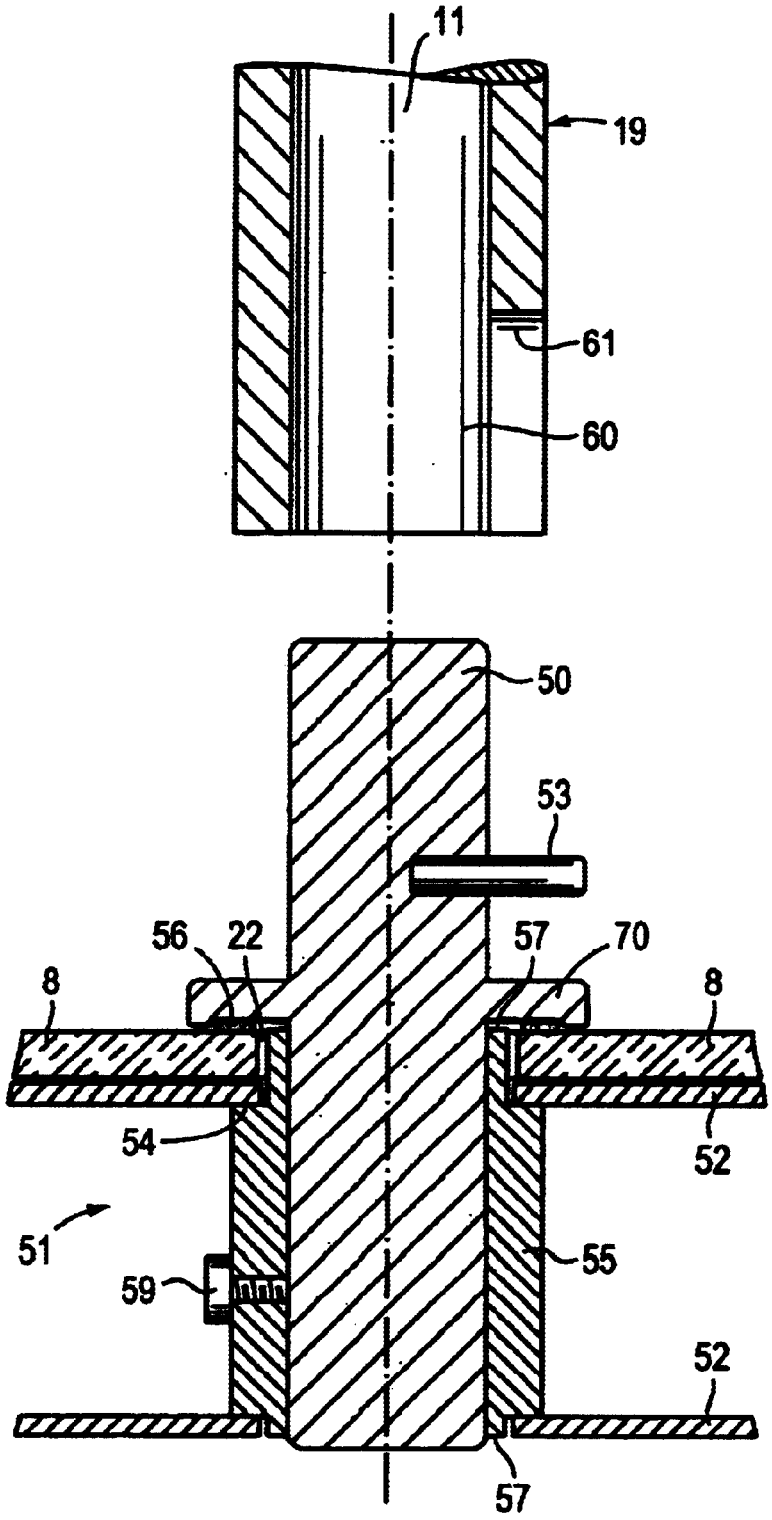
FIG. 7 shows a sectional view of an anchoring of the baking tray mounting arrangement attached to the trap-door with one support column removed from it.
Figure 8:
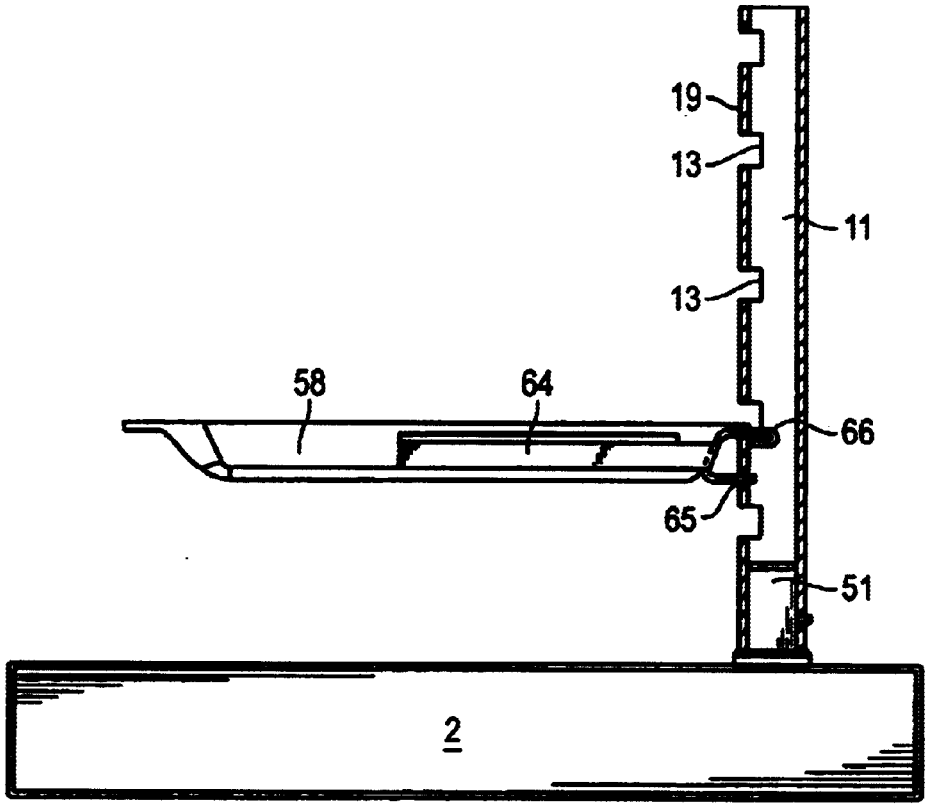
FIG. 8 shows a sectional view of the trap-door having a support column mounted on it into which a baking tray has been hooked.

As already mentioned above, and as shown in FIGS. 5, 7 and 8 the baking tray mounting arrangement 19, 51 is mounted on the upper surface of the trap-door 2 and is contained within the cooking space 32, when the trap-door 2 is closed. The baking tray mounting arrangement, according to FIG. 8, includes the fixing piece 19 for hooking up baking trays and an anchoring 51 next to the trap-door 2. In the present embodiment the fixing piece 19 includes two hollow-cylindrical support columns 11. Each of the support columns 11 has cut-outs 13 on the same respective levels formed into it, into which the baking tray 58 is hooked as shown in FIG. 8. The support columns 11 are arranged in the rear area of the cooking space 32, i.e. between the hob 10 and the sealed zone 18 indicated as a broken line.

Now the mounting of the support columns 11 in the anchoring 51 fastened in the trap-door 2 according to the invention will be discussed. Each anchoring 51, according to FIG. 6, consists of a profiled sheet 52 shaped as a "U", of which one side is attached to an inside wall of the trap-door 2. A hollow-cylindrical bearing piece 55 is placed in between the arms 53, 63 of each U-profile sheet 52. Each longitudinal end 54 of the bearing piece 55 includes a portion 57 of reduced diameter. These portions 57 are retained in opposite openings of the arms of each U-profile sheet 52 as shown in FIG. 7. FIG. 7 also shows that a cylindrical base 50 is mounted inside each hollow-cylindrical bearing piece 55 which can be fixed in the bearing piece 55 by means of a locking screw 59.

The hollow profile 60 of each support column 11, according to FIG. 7, corresponds to the shape of the cylindrical base 50 in such a way that the support columns 11 can be placed so as to fit loosely onto each of the bases 50. The cylindrical wall 60 of each support column 11 also comprises a recess 61 which receives a positioning pin 53 formed on the base 50 when the support column 11 is accurately placed onto the base 50.

In order to seal the mounting holes 22 in the glass-ceramic plate 8 receiving the bases 50, each base 50 is formed with an annular flange 70 in its central area according to FIG. 7. The outer diameter of the annular flange 70 is larger than the diameter of the mounting hole 22 so that the annular flange 70 of the base 50 covers the mounting hole 22. An O-ring seal 56 is arranged between the annular flange 70 and the glass-ceramic plate 8. When the bearing piece 55 is mounted in the base 50 the annular flange 70 can exert a certain pressure upon the glass-ceramic plate 8 via the O-ring seal 56, which rests on the profiled sheet 52 of the anchoring 51 serving as a buttress. Thus the anchoring 51 is securely sealed relative to the glass-ceramic plate 8.

Figure 9:
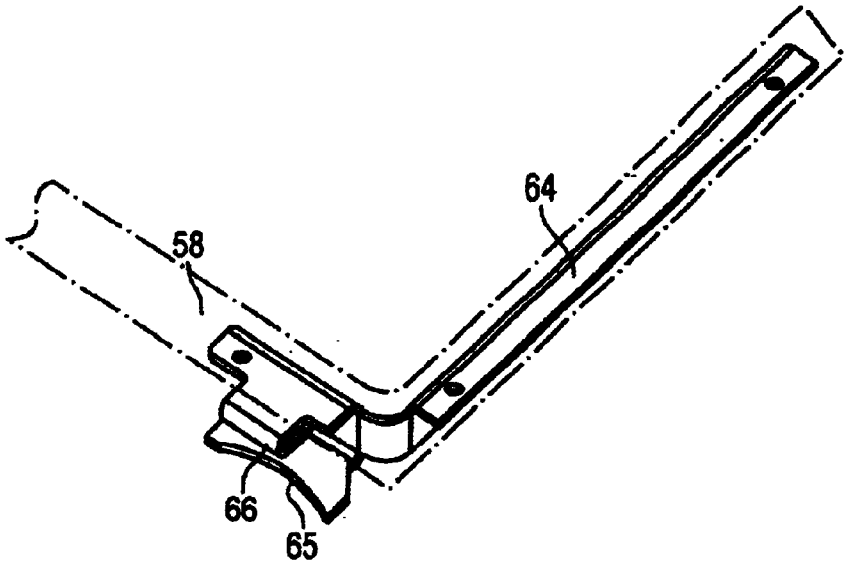
FIG. 9 shows a perspective view of a support piece attached to the baking tray.

On each of its narrow sides the baking tray 58 is provided with a support piece 64, which is arranged below a horizontal rim of the baking tray 58 indicated by a chain-dotted line as shown in FIG. 9. According to FIG. 9 each support piece 64 has mounting projections 65, 66. When the baking tray 58 is hooked into the support columns 11, the upper mounting projections 66 of the support pieces 64 of the baking tray 58 shown in FIG. 9 are initially inserted into the window-like cut-outs 13 and come to rest against the inside wall of the support column 11, whilst the lower mounting projections 65 of the support pieces 64 of the baking tray 58, come to rest against an outside wall of the support column 11. Due to the torque exerted upon the mounting projections 65, 66 of the baking tray 58, the mounting projections 65, 66 remain resting securely against the inside and outside wall of the support columns 11.

With the help of a control provided on the control panel of the control unit 34 the high-level built-in oven unit 100 may be switched between a hotplate mode and a bottom heat mode, and these will now be discussed.

In the hotplate mode the hotplate heating elements 5, 6 can be individually operated via controls provided on the control panel of the control unit 34, whilst the sheet-type heating element 7 is inoperative. The hotplate mode can be used with the trap-door 2 lowered as shown in FIG. 1. But it can also be used in an energy-saving function when the cooking space 32 is closed due to the trap-door 2 having been raised.

In the bottom heat mode, according to the invention, not only the hotplate heating elements 5, 6 but also the sheet-type heating element 7 is controlled from the control unit 34. Moreover, when using the bottom heat mode, a top-heat heating element (not illustrated) provided at the top of the heated chamber 21 may be controlled from the control unit 34.

To ensure that the food browns as evenly as possible in bottom heat mode, it is critical that the hob 10 providing the bottom heat supplies an evenly distributed heat output across its surface, although the heating elements 5, 6, 7 have different nominal outputs. Therefore, according to the invention, the heating elements 5, 6, 7 are not switched by the control unit 34 to continuous operation, but the power supply to the heating elements 5, 6, 7 is clocked by switching elements (not illustrated) controlled by the control unit 34. With this arrangement the different nominal outputs of the heating elements 5, 6, 7 are individually reduced in such a way that the heating elements 5, 6, 7 produce an evenly distributed heat output across the surface of the hob 10.

This sufficiently evenly distributed heat output may be adjusted by means of a further control of the control unit 34 by the user depending upon the heat output required.

What is claimed is:

1. A high-level built-in oven unit, comprising:

a housing having a heated chamber including a cooking space and a floor opening;

said floor opening including a lowerable trap-door which is movable between a position closing said floor opening and a lower position which opens said floor opening;

said lowerable trap-door movable by a lifting device which includes lifting elements connected to said lowerable trap-door, said lifting device mounted in said housing;

at least one fixing piece forming part of a baking tray mounting arrangement for hooking baking trays into said fixing piece, said fixing piece detachably attached to said trap-door; and said baking tray mounting arrangement including an anchoring portion attached to said trap-door and said fixing piece including a portion mountable with said anchoring portion, said fixing piece portion and said anchoring portion pluggable relative to one another to form said baking tray mounting arrangement.

2. The oven unit according to claim 1, including said fixing piece attached spatially separate from said lifting elements.

3. The oven unit according to claim 1, including said fixing piece is manually attachable and detachable to said trap-door without use of any tools.

4. The oven unit according to claim 1, including said fixing piece including a plug-in portion which is pluggable into said anchoring portion.

5. The oven unit according to claim 4, including said anchoring portion including a substantially cylindrical base and said fixing piece plug-in portion has a mating corresponding hollow profile which mounts over said cylindrical base.

6. The oven unit according to claim 5, including said cylindrical base having a positioning pin extending therefrom and said fixing piece plug-in portion including a corresponding recess which mates with said pin when said fixing piece is mounted on said base.

7. The oven unit according to claim 4, including said anchoring portion covered by a heat-resistant plate with said cylindrical base extending through a mounting hole formed in said plate.

8. The oven unit according to claim 7, including said heat-resistant plate formed from a glass-ceramic vitreous material.

9. The oven unit according to claim 7, including an O-ring seal mounted between an annular flange formed on said cylindrical base and a circumferential area surrounding said mounting hole formed in said plate.

10. The oven unit according to claim 4, including said fixing piece including a pair of support columns substantially identical with one another and each said support column including said plug-in portion pluggable into said anchoring portion of said baking tray mounting arrangement.

11. A baking tray mounting arrangement for high-level built-in oven unit, the unit including a housing having a heated chamber including a cooking space and a floor opening, the floor opening including a lowerable trap-door which is movable between a position closing the floor opening and a lower position which opens the floor opening and the lowerable trap-door movable by a lifting device including lifting elements connected to the lowerable trap-door, the lifting device mounted in the housing, said arrangement comprising:

at least one fixing piece forming part of the baking tray mounting arrangement for hooking baking trays therein, said fixing piece detachably attached to said trap-door; and said baking tray mounting arrangement including an anchoring portion attached to said trap-door and said fixing piece including a portion mountable with said anchoring portion, said fixing piece portion and said anchoring portion pluggable relative to one another to form said baking tray mounting arrangement.

12. The oven unit according to claim 11, including said fixing piece attached spatially separate from said lifting elements.

13. The oven unit according to claim 11, including said fixing piece is manually attachable and detachable to said trap-door without use of any tools.

14. The oven unit according to claim 11, including said fixing piece including a plug-in portion which is pluggable into said anchoring portion.

15. The oven unit according to claim 14, including said anchoring portion including a substantially cylindrical base and said fixing piece plug-in portion has a mating corresponding hollow profile which mounts over said cylindrical base.

16. The oven unit according to claim 15, including said cylindrical base having a positioning pin extending therefrom and said fixing piece plug-in portion including a corresponding recess which mates with said pin when said fixing piece is mounted on said base.

17. The oven unit according to claim 14, including said anchoring portion covered by a heat-resistant plate with said cylindrical base extending through a mounting hole formed in said plate.

18. The oven unit according to claim 17, including said heat-resistant plate formed from a glass-ceramic vitreous material.

19. The oven unit according to claim 17, including an O-ring seal mounted between an annular flange formed on said cylindrical base and a circumferential area surrounding said mounting hole formed in said plate.

20. The oven unit according to claim 14, including said fixing piece including a pair of support columns substantially identical with one another and each said support column including said plug-in portion pluggable into said anchoring portion of said baking tray mounting arrangement.

* * * * *